US012601535B2

(12) United States Patent
Kaemingk

(10) Patent No.: US 12,601,535 B2
(45) Date of Patent: Apr. 14, 2026

(54) GLASS HEAT ZONE CONTROL

(71) Applicant: Hill Phoenix, Inc., Conyers, GA (US)

(72) Inventor: Nate Kaemingk, Tyrone, GA (US)

(73) Assignee: Hill Phoenix, Inc., Conyers, GA (US)

( * ) Notice: Subject to any disclaimer, the term of this patent is extended or adjusted under 35 U.S.C. 154(b) by 273 days.

(21) Appl. No.: 18/135,572

(22) Filed: Apr. 17, 2023

(65) Prior Publication Data

US 2024/0344755 A1 Oct. 17, 2024

(51) Int. Cl.
*F25D 21/08* (2006.01)
*F25D 21/00* (2006.01)
*F25D 23/02* (2006.01)

(52) U.S. Cl.
CPC ..... *F25D 21/006* (2013.01); *F25D 21/08* (2013.01); *F25D 23/028* (2013.01)

(58) Field of Classification Search
CPC ..... F25D 21/006; F25D 21/08; F25D 23/028
See application file for complete search history.

(56) References Cited

U.S. PATENT DOCUMENTS 3,524,920 A * 8/1970 Heaney ..... H05B 3/06 174/250
3,911,245 A * 10/1975 O'Shaughnessy ..... H05B 3/84 219/218
4,127,765 A 11/1978 Heaney
4,940,884 A 7/1990 Gillery
7,891,153 B2 2/2011 Cording
8,299,400 B2 10/2012 Prone et al.
8,881,542 B2 11/2014 Hixson et al.
9,155,405 B2 10/2015 Artwohl et al.
10,655,904 B2 5/2020 Aiken et al.
11,076,453 B2 7/2021 Baruzier et al.
11,454,440 B2 9/2022 Myli et al.
11,578,911 B2 2/2023 Kaemingk
11,903,499 B2 2/2024 Kaemingk et al.
2007/0188843 A1 8/2007 Stroumbos et al.
2014/0260384 A1* 9/2014 Millett ..... F25D 21/08 219/218
2018/0146797 A1* 5/2018 Artwohl ..... A47F 3/0434
2021/0307540 A1 10/2021 Kaemingk et al.
2021/0348834 A1 11/2021 Kaemingk
2021/0369008 A1 12/2021 Gundurao et al.
2022/0264704 A1 8/2022 He et al.

FOREIGN PATENT DOCUMENTS

WO WO 2004/103926 12/2004

* cited by examiner

*Primary Examiner* — Jonathan Bradford
(74) *Attorney, Agent, or Firm* — Fish & Richardson P.C.

(57) ABSTRACT

A refrigerated display case door glass panel assembly includes a first pane of glass and a second pane of glass bounding a sealed space between the panes, and an electrically conductive coating applied to a surface of the first pane. The coating extending across at least a majority of a viewing area of the first pane. A first pair of electrical buses spaced apart from one another and electrically connected to the coating at respective first and second ends of the first pane, the first and second ends being opposite one another, and a second pair of electrical buses spaced apart from one another and electrically connected to the coating at respective third and fourth ends of the first pane. The third and fourth ends being opposite one another and adjacent to the first and second ends.

20 Claims, 6 Drawing Sheets

GLASS HEAT ZONE CONTROL

TECHNICAL FIELD

The present disclosure relates to condensation control on glass panels for temperature-controlled environments.

BACKGROUND

Refrigerated enclosures are used in commercial, institutional, and residential applications for storing and/or displaying refrigerated or frozen objects. Refrigerated enclosures may be maintained at temperatures above freezing (e.g., a refrigerator) or at temperatures below freezing (e.g., a freezer). Refrigerated enclosures have one or more doors or windows for viewing and accessing refrigerated or frozen objects within a temperature-controlled space. Doors for refrigerated enclosures can include glass panel assemblies.

SUMMARY

In one aspect, a refrigerated display case door glass panel assembly includes a first pane of glass and a second pane of glass bounding a sealed space between the panes; and an electrically conductive coating applied to a surface of the first pane, the coating extending across at least a majority of a viewing area of first pane; a first pair of electrical buses spaced apart from one another and electrically connected to the coating at respective first and second ends of the first pane, the first and second ends being opposite one another; and a second pair of electrical buses spaced apart from one another and electrically connected to the coating at respective third and fourth ends of the first pane, the third and fourth ends being opposite one another and adjacent to the first and second ends.

In one aspect, a refrigerated display case door includes a glass panel assembly including a first pane of glass and a second pane of glass bounding a sealed space between the panes; and an electrically conductive coating applied to a surface of the first pane, the coating extending across at least a majority of a viewing area of first pane; a first pair of electrical buses spaced apart from one another and electrically connected to the coating at respective first and second ends of the first pane, the first end positioned at a top of the door and the second end positioned at a bottom of the door; and a second pair of electrical buses spaced apart from one another and electrically connected to the coating at respective third and fourth ends of the first pane, the third and fourth ends being opposite one another and adjacent to the first and second ends.

In one aspect, a condensation control system configured to control power flow to a first pair of electrical buses and a second pair of electrical buses, each pair of electrical buses connected, at different locations, to an electrically conductive coating on a glass surface of a refrigerated display case door.

Embodiments of these aspects may include one or more of the following features.

In some embodiments, these aspects include a third pair of electrical buses spaced apart from one another and spaced apart from the second pair of electrical buses, the third pair of electrical buses electrically connected to the coating at the respective third and fourth ends of the first pane.

In some embodiments, one of the electrical buses in the first pair includes a U-shape that extends completely across the second end of the first pane and partially extends along the third and fourth ends.

In some embodiments, the first pair of electrical buses receive power from a first power supply, and the second pair of electrical buses receive power from a second power supply, the second power supply configured to supply more power than the first power supply.

In some cases, the second power supply is configured to supply a higher output voltage than the first power supply.

In some cases, the second end of the first pane forms a bottom end of the glass panel assembly when mounted in a door, where an electrical bus of the first pair of electrical buses positioned at the second end of the first pane is connected to an electrical ground, an electrical bus of the first pair of electrical buses positioned at the second end of the first pane is electrically connected to an output of the first power supply, and each of the second pair of electrical buses are electrically connected to an output of the second power supply.

In some embodiments, each bus of the first pair of electrical buses extends entirely across the respective first or second end of the first pane, and each bus of the second pair of electrical buses extends along only a portion of the respective third or fourth end of the second pane.

In some embodiments, an electrical bus of the first pair of electrical buses positioned at the second end of the first pane is connected to an electrical ground, an electrical bus of the first pair of electrical buses positioned at the second end of the first pane is electrically connected to an output of the first power supply, and each of the second pair of electrical buses are electrically connected to an output of the second power supply.

In some embodiments, these aspects include a controller configured to supply power independently to the first pair of electrical buses and the second pair of electrical buses. In some cases, the controller is configured to control power flow to the first pair of buses and the second pair of buses to provide more heating current proximate to the bottom of the door than to the top of the door.

In some embodiments, the control system is configured to control the power flow to the first pair of electrical buses and the second pair of electrical buses such that more heating current flows proximate to a bottom of the door than to a top of the door.

In some embodiments, the control system includes at least one condensation sensor, and the control system is configured to control a voltage applied to the first pair of electrical buses and the second pair of electrical buses responsive to input received from the at least one condensation sensor.

In some embodiments, the first pair of electrical buses are spaced apart from one another and electrically connected to the coating at respective first and second ends of the glass surface, the first end positioned at a top of the door and the second end positioned at a bottom of the door, and the second pair of electrical buses are spaced apart from one another and electrically connected to the coating at respective third and fourth ends of the glass surface, the third and fourth ends being opposite one another and adjacent to the first and second ends.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
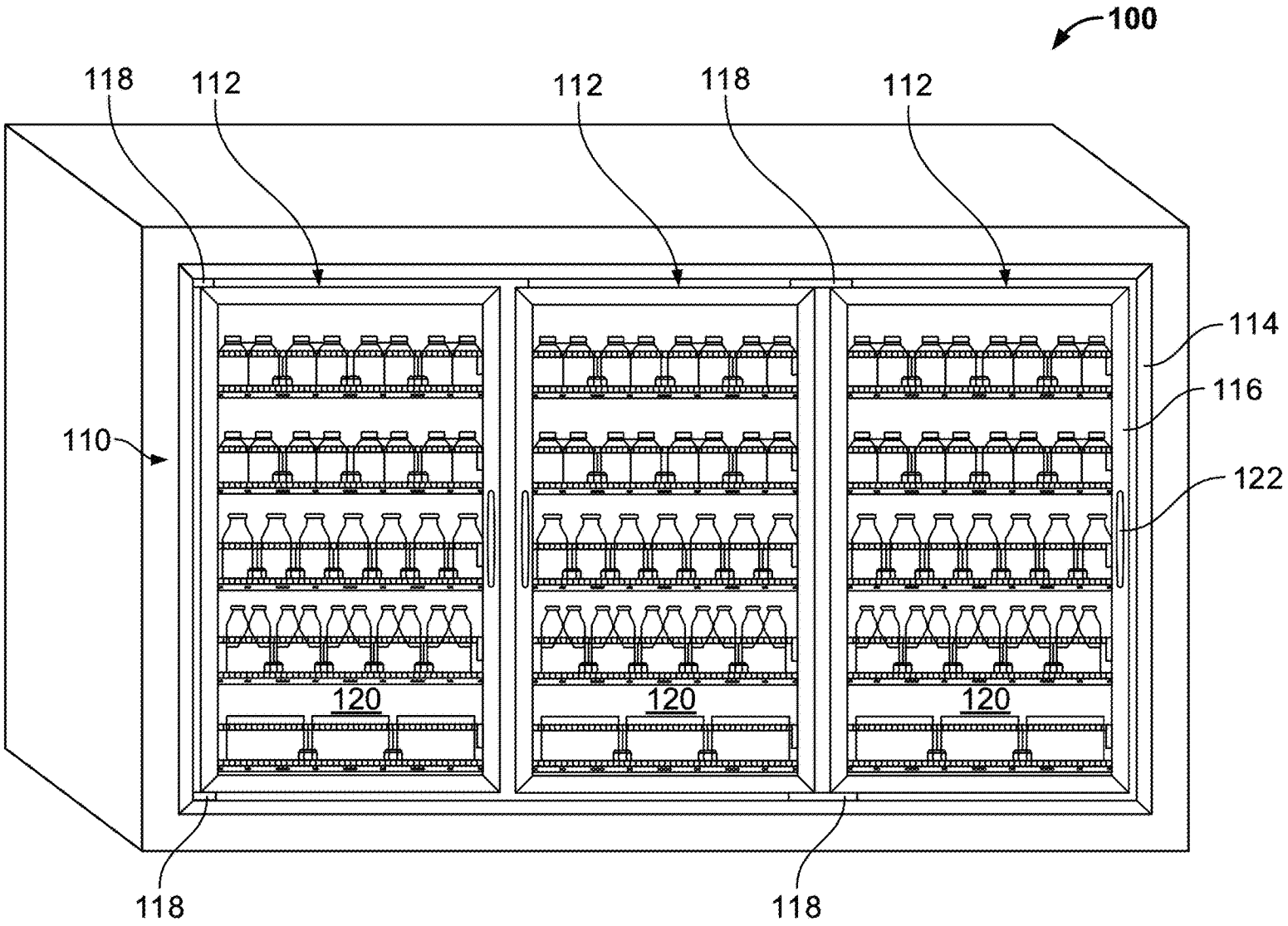
FIG. 1 is a perspective view of a display case door assembly including three display case doors mounted to a display case frame, each door having a transparent panel assembly, according to an exemplary implementation.
Figure 2:
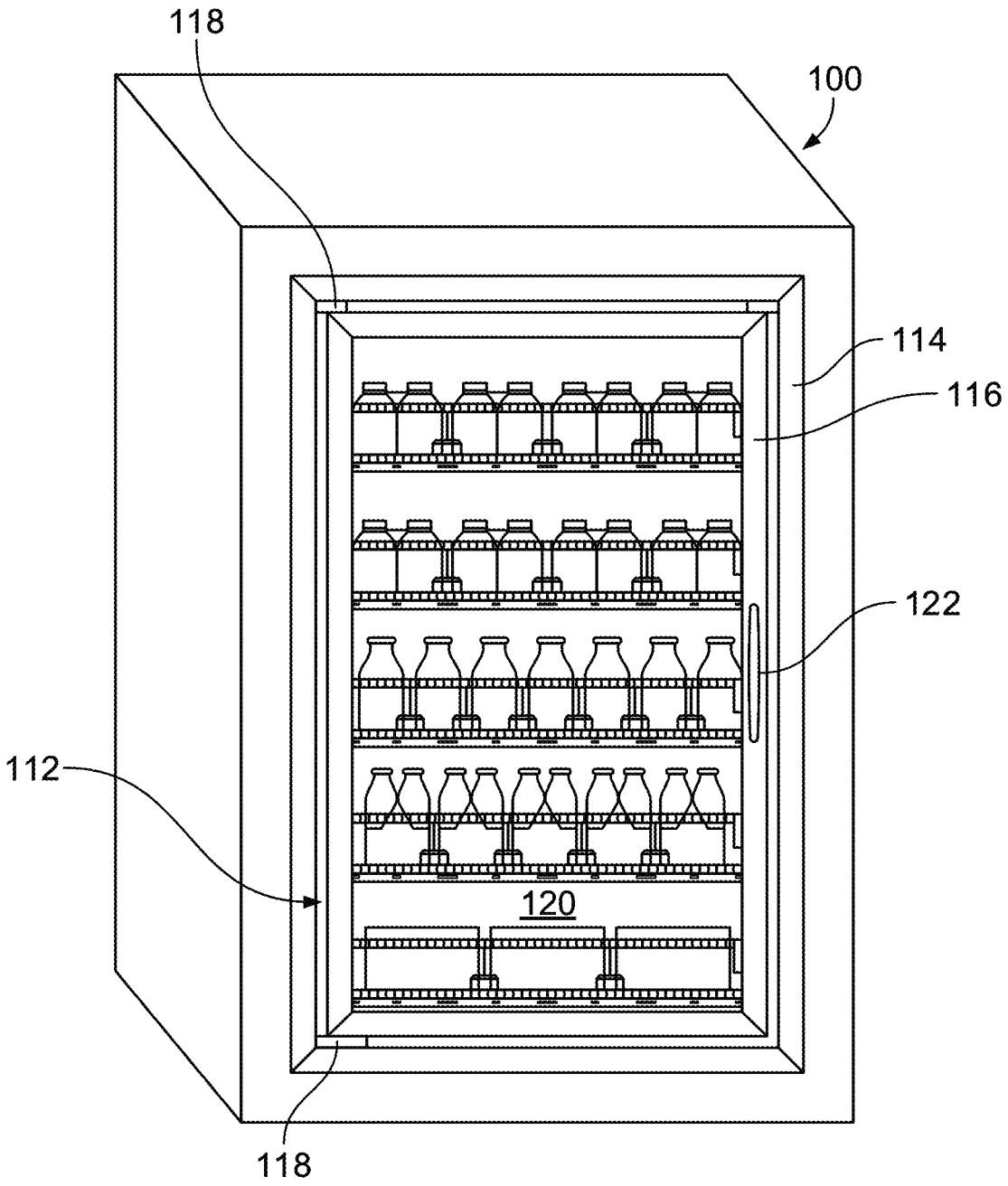
FIG. 2 is a front elevation view of the display case door assembly of FIG. 1, according to another exemplary implementation.

FIGS. 1-2 illustrate an exemplary display case door assembly 110 installed in a refrigerated display case 100. The refrigerated display case 100 may be a refrigerator, freezer, or other enclosure defining a temperature-controlled space. For example, refrigerated display case 100 may be a refrigerated display case or refrigerated merchandiser in grocery stores, supermarkets, convenience stores, florist shops, and/or other commercial settings to store and display temperature-sensitive consumer goods (e.g., food products and the like). Refrigerated display case 100 can be used to display products that must be stored at relatively low temperatures and can include shelves, glass doors, and/or glass walls to permit viewing of the products supported by the shelves. In some implementations, refrigerated display case 100 is a refrigerated display unit used, for example, in warehouses, restaurants, and lounges. For example, refrigerated display case 100 can be a free-standing unit or "built in" unit that forms a part of the building in which the refrigerated display case 100 is located.

Display case door assembly 110 includes a plurality of display case doors 112 mounted in a display case frame 114. Each display case door 112 includes a panel assembly 120 mounted in a door frame 116. Doors 112 each include a handle 122. Doors 112 are pivotally mounted on the case frame 114 by hinges 118. In some implementations, doors 112 can be sliding doors configured to open and close by sliding relative to the case frame 114.

As discussed in more detail below, panel assembly 120 includes an electrically conductive coating disposed between panes of glass in the panel assembly 120. The electrically conductive coating can be used to mitigate condensation that can form on the panel assembly 120 if a pane of glass of the panel assembly 120 is at a temperature below the dew point of humid air in the ambient environment outside of the display case 100. For example, if the panel assembly 120 is installed in a door 112 of a freezer, the side of the panel assembly 120 facing the inside of the freezer can have a temperature below the dew point of the air outside the freezer. When a consumer opens the door 112 to access the inside of the freezer, the side of the panel assembly 120 that was facing the inside of the freezer is exposed to the humid ambient environment, and water vapor within the air can condense on the pane of glass. To mitigate the formation of condensation, the electrically conductive coating can be used to heat the pane of glass. In some cases, the electrically conductive coating can heat the pane of glass to a temperature above the dew point of the ambient environment outside of the display case 100.

In some implementations, panel assembly 120 may be used as part of a door assembly configured to provide a thermal insulation effect (e.g., for a refrigerated display case) or otherwise used as any type of transparent or substantially transparent panel that provides a thermal insulation effect (e.g., a sliding or hinged window, a fixed-position window, a revolving or sliding door, a hinged door, etc.). In some implementations, panel assembly 120 may be used as an insulated window or for a display case 100.

Door frame 116 extends around each of the top, bottom, and side edges of panel assembly 120. For example, door frame 116 includes a top frame member, a bottom frame member, and two side frame members. Door frame 116 may be attached to the edges of the panel assembly 120 by a friction fit of an adhesive. In some implementations, door frame members may be attached to one another using mechanical fasteners.

In some implementations, one or more sides of door frame 116 can be omitted to provide a frameless display case door 112. For example, panel assembly 120 can be mounted within the opening into the display case 100 by a rail mounted on one side of the assembly 120. The rail can be mounted on hinges 118 to attach panel assembly 120 to the display case 100 without requiring a complete frame to support and/or contain panel assembly 120. Omitting portions of the door frame 116 may enhance a minimalistic appearance of the display case door assembly 110 and supplement the aesthetics provided by panel assembly 120, which appears as a single pane of glass.

Display case door 112 includes a handle 122. Handle 122 may be used to open, close, lock, unlock, seal, unseal, or otherwise operate display case door 112. Handle 122 can be made from extruded aluminum tubes that are cut to a specified dimension and bonded to a front surface of display case door 112. In some implementations, handle 122 may be attached to a member of a door frame. In some implementations, handle 122 may be attached to the panel assembly 120, e.g., using an adhesive or epoxy.

Panel assembly 120 includes one or more panes of transparent or substantially transparent glass (e.g., insulated glass, non-tempered glass, tempered glass, etc.), plastics, or other transparent or substantially transparent materials. In some implementations, panel assembly 120 includes multiple layers of transparent panes (e.g., multiple panes per door 112). Panel assembly 120 also includes an electrically conductive coating disposed between two of the panes of glass. For example, the electrically conductive coating can be disposed between the first pane of glass and the second pane of glass. When an electric current is supplied to the electrically conductive coating, the coating provides heat to the pane of glass nearest to the coating.

In some implementations, door 112 is oriented within a temperature-controlled display case 100 such that the side of panel assembly 120 on which the electrically conductive coating is located is oriented towards the environment with the coldest temperature. For example, if the temperature-controlled display case 100 shown in FIG. 1 is a refrigerator or a freezer, panel assembly 120 would be oriented such that the electrically conductive coating is oriented nearest the inside surface of the panel assembly 120. The electrically conductive coating can be used to provide a desired amount of heat directly to the side of panel assembly 120 at the colder temperature, thereby reducing the likelihood of forming condensation on panel assembly 120. In some implementations (e.g., a freezer), the amount of current supplied to the electrically conductive coating can be chosen to be sufficient to reduce the likelihood of condensation formation without unnecessarily radiating additional heat into the freezer. The electrically conductive coating can be applied to a surface of a pane of glass inside of panel assembly 120 (e.g., between glass panes of panel assembly 120), e.g., to avoid exposing consumers to risk of electrical shock from the coating.

For simplicity, in the remainder of this disclosure panel assembly 120 is described as if it is installed in a freezer such that the inside surface of panel assembly 120 is nominally at a lower temperature than the outside surface when the door 112 is closed.

Figure 3B:
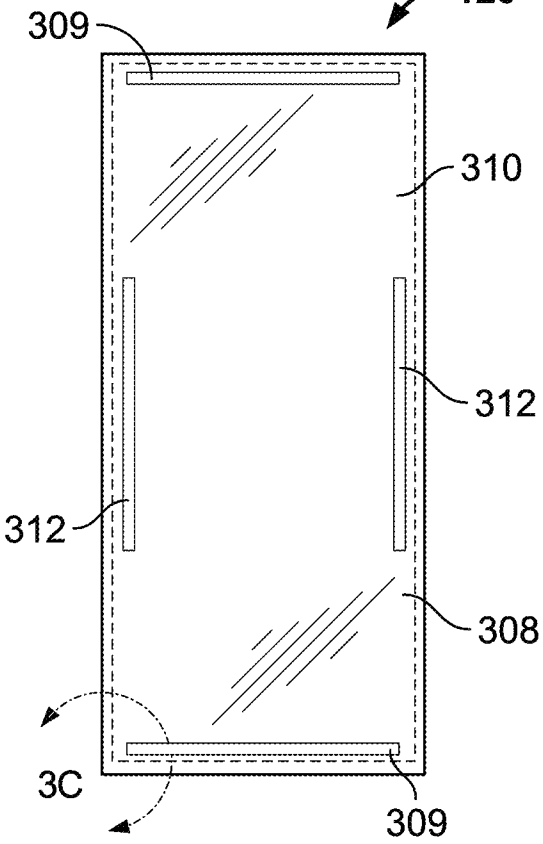
FIG. 3B is a front elevation view of the exemplary panel assembly shown in FIG. 3A.
Figure 3A:
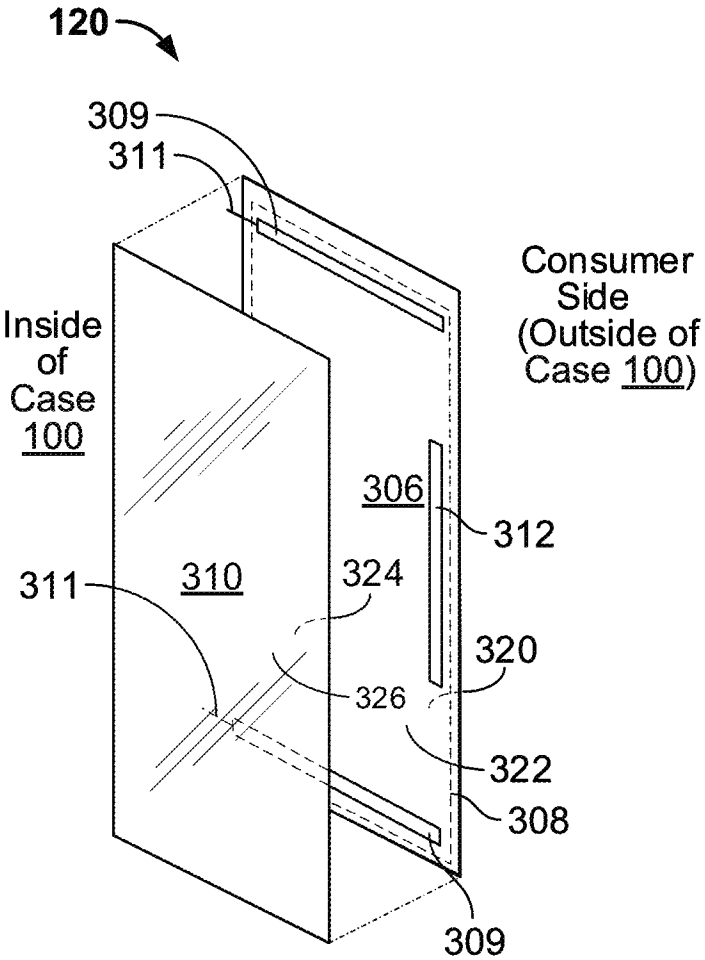
FIG. 3A is an exploded view of the exemplary panel assembly shown in FIG. 1.

FIGS. 3A-3B include drawings illustrating a representative panel assembly 120 in greater detail. FIG. 3A is an exploded view of panel assembly 120, and FIG. 3B is a front elevation view of panel assembly 120.

Panel assembly 120 includes a front pane 306, an electrically conductive coating 308, and a rear pane 310. Front pane 306 has an outside surface 320 (e.g., which also serves as the outside surface of the panel assembly 120) and an inside surface 322. For example, outside surface 320 faces toward a consumer standing in front of the display case when door 112 is closed. Inside surface 322 faces toward merchandise within the display case when door 112 is closed. Rear pane 310 has a first surface 324 and a second surface 326 (e.g., which also serves as the inside surface of the panel assembly 120). For example, first surface 324 faces toward a consumer standing in front of the display case when door 112 is closed. Second surface 326 faces toward merchandise within the display case when door 112 is closed.

Electrically conductive coating 308 can be applied to either second surface 322 of front pane 306 or first surface 324 of rear pane 310. Rear pane 310 is placed in contact with the second surface 322 of front pane 306.

The electrically conductive coating 308 extends across a majority of the viewing area of panel assembly 120. For example, the viewing area may be that portion of the inside surface 324 and outside surface 326 of panel assembly 120 that is not covered by door frame 116. In some implementations, electrically conductive coating 308 extends across the entire viewing area of panel assembly 120. In some implementations (as shown in FIG. 3C), the edges 336 of electrically conductive coating 308 do not extend to the edges 338 of panel assembly 120. For example, edges 336 of electrically conductive coating 308 can be deleted such that the there is a gap of a distance "X" between the edge 336 of electrically conductive coating 308 and an edge 338 of panel assembly 120. For example, the edges 336 of electrically conductive coating 308 can be deleted such that the gap is formed between the edge 336 of electrically conductive coating 308 and an edge 338 of front pane 306, or an edge of rear pane 310 depending on which surface (322 or 324) electrically conductive coating 308 is placed. The gap may extend around the entire perimeter of electrically conductive coating 308. For example, the gap may be a distance "X" of about 0.25 inches from the edge 338 of panel assembly 120. In some implementations, the gap may be a distance of about 0.25 inches from an edge of solder seal on panel assembly 120.

Electrically conductive coating 308 can be a high voltage/high power coating (e.g., greater than about 30 V RMS (42.4 V peak) or 60 V DC) capable of quickly clearing condensation disposed between front pane 306 and rear pane 310 for increased safety. Such implementations may also improve the energy efficiency of the display case 100, because power can be rapidly supplied to electrically conductive coating 308 to quickly clear condensation while door 112 is open, thereby reducing the heat that needs to be applied when the door 112 is closed and which would be transmitted into the refrigerated display case 100.

In some implementations, electrically conductive coating 308 is applied to the exposed surface 326 of rear pane 310. In such implementations, electrically conductive coating 308 may be a coating that uses only low voltages (e.g., less than about 30 V RMS (42.4 V peak) or 60 V DC) for consumer safety.

Figure 3D:
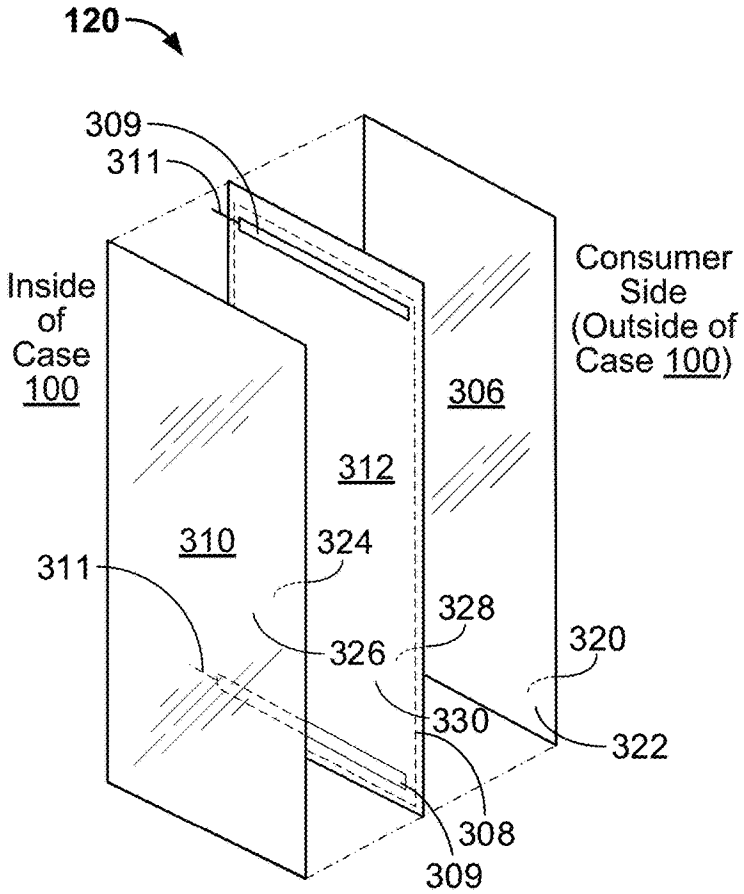
FIG. 3D is an exploded view of the exemplary panel assembly shown in FIG. 1.
Figure 3C:
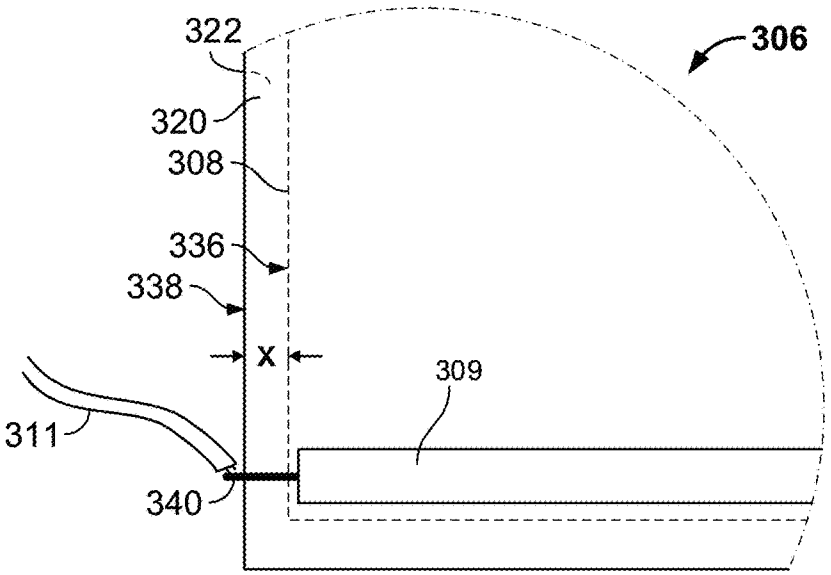
FIG. 3C is a detail view of a portion of the exemplary glass panel and electrically conductive coating of the panel assembly.

FIG. 3D shows an exploded view of an example panel assembly 120 including 3 glass panes: front pane 306, rear pane 310, and middle pane 312. Middle pane 312 includes a front surface 328 and a rear surface 330. In the embodiment shown, electrically conductive coating 308 is applied to the rear surface 330 of middle pane 312. The electrically conductive coating 308 can be applied to the rear surface 322 of the front pane 306, the front surface 328 of the middle pane 312, the rear surface 330 of the middle pane 312, or the front surface 324 of the rear pane. The electrically conductive coating 308 transmits heat to the front pane 306 or rear pane 308 of panel assembly 120 through, for example, conductive heat transfer (e.g., when the electrically conductive coating 308 is applied directly to front pane 306 or rear pane 308) and through radiative heat transfer (e.g., when the electrically conductive coating 308 is applied to either surface of the middle pane 312).

In some implementations, there is a gas in the sealed space between adjacent panes of glass. For example, a gas may fill the sealed space between front pane 306 and rear pane 310 as shown in FIG. 3A, or a gas may fill the sealed spaces between front pane 306, middle pane 312, and rear pane 310. Gases that may fill the sealed spaces between panes can include for example, air, dry air, or dry nitrogen. In some cases, the sealed spaces between the panes of glass can be evacuated of gas forming a vacuum. A vacuum between panes of glass can provided more thermal insulation between the inside of refrigerated display case 100 and the ambient environment outside of the display case 100 than a panel assembly 120 that does not include a vacuum in the sealed spaces between panes of glass.

As noted above, electrically conductive coating 308 can be used to apply heat across the viewing area of the panel assembly 120 between front pane 306 and rear pane 310. For example, electrically conductive coating 308 can be used to provide a desired amount of heat to rear pane 310 to reduce some of the thermal stresses that may form across panel assembly 120. In some implementations (e.g., a freezer), a sufficient current can be supplied to the electrically conductive coating so as to reduce thermal stresses, while minimizing the amount of heat that may radiate into a freezer (e.g., through rear pane 310). The heat produced by electrically conductive coating 308 helps to prevent or remove condensation from rear pane 310, for example, when a freezer door 112 is opened into a humid environment. That is, in a freezer the temperature of the inside surface of panel assembly 120 may be below the dew point of the external environment. When a customer opens door 112, water vapor in the air may tend to condense on the inside surface. The heat produced by electrically conductive coating 308 may warm the inside surface sufficiently to prevent the condensation from forming, or to aid in rapidly clearing any condensation that may form.

In some implementations, electrical power is supplied to electrically conductive coating 308 by a first pair of parallel bus bars 309. Bus bars 309 are spaced apart from each other and are electrically connected to opposites sides of electrically conductive coating 308. For example, bus bars 309 can be connected to the top and bottom of electrically conductive coating 308 (e.g., as illustrated in FIG. 3A). In some implementations, bus bars 309 can be connected to electrically conductive coating 308 on either side of the coating 308 (e.g., left and right sides). Each bus bar may include an electrode 340 or solder tab for connecting the electrically conductive coating to lead wires 311 connected to an electrical power source. In this arrangement, electric current may pass through one of the lead wires 311, to a first of the bus bars 309, across the electrically conductive coating 308 to the second bus bar 309, and through the other lead wire 311. The electric current causes heat to be generated across panes 306/310 (e.g., due to electrical resistance of the coating). In some implementations, electrically conductive coating 308 is a metal oxide coating (e.g., tin oxide or silver coatings).

In some implementations, a second pair of parallel bus bars 312 can be used to supply additional power to the electrically conductive coating 308. The second pair of bus bars 312 are spaced apart from each other, electrically connected to opposite sides of electrically conductive coating 308, and on different edges of the coating than the first pair of bus bars 309. For example, if the first pair of bus bars 309 are connected to the top and bottom edges of electrically conductive coating 308, then the second pair of bus bars 312 can be connected to the left and right sides of electrically conductive coating 308.

The addition of a second pair of parallel bus bars 312 can be used to shape the current flowing through the electrically conductive coating and thereby generate heat in designated zones of the panel assembly 120. For example, the bottom of panel assembly 120 may generally be at a colder temperature than the top of panel assembly 120 due to the natural rising of heat; thus, the bottom of the panel assembly 120 may be more prone to forming condensation than the top. It can then be desirable to heat the bottom of panel assembly 120 more than the top of the assembly. This can be achieved by shaping the current flowing through the electrically conductive coating 308 to have a higher current in portions of the coating near the bottom of the glass pane and a lower current in portions of the coating near the top of the glass pane.

In some implementations, electrically conductive coating 308 is applied to one or more of the panes 306 and 310. For example, electrically conductive coating 308 may be applied to surface 322 of front pane 306 or surface 324 of rear pane 310.

In some implementations, one or more of surfaces 320-326 have a film or coating applied. For example, an anti-condensate film or coating may be applied to one or more of surfaces 320-326. Example anti-condensate films and coatings include, but are not limited to, pyrolytic coatings and mylar coatings. For example, the anti-condensate film or coating may be applied to surface 326 to help prevent the contamination of merchandise in the temperature-controlled display case 100 in the event that front pane 306 or rear pane 310 are damaged (e.g., by containing glass shards). The anti-condensate coating can be applied to any of surfaces 320-326 of panel assembly 120. The anti-condensate coating can be applied by spraying, adhering, laminating, or otherwise depositing the coating (e.g., using chemical vapor deposition or any other suitable technique) onto a surface 320-326. In some implementations, the anti-condensate coating is made of a self-healing material (e.g., urethane) and is capable of healing scratches.

In some implementations, a display case door 112 is configured to maximize visible light transmission from inside the case to the customer, thereby, improving the ability of customers to view display items. In some implementations, it may be desirable to minimize the transmission of non-visible light (i.e., ultraviolet and infrared light) through panel assembly 120 from outside to inside the case in order to improve thermal performance (e.g., by reducing radiation heat transfer) and to protect items therein. An anti-transmissive coating may be applied to one or more of the panes 306 and 310. The anti-transmissive coating may absorb or reflect infrared light, ultraviolet light, or any combination thereof. The anti-transmissive coating may absorb or reflect some frequencies of visible light in addition to infrared and/or ultraviolet light.

In some implementations, it can be desirable to heat specific zones of panel assembly 120 more or less than other zones. For example, in a vertically oriented panel assembly, the top of the assembly may need less heat applied to remain condensation free than the bottom of the door since heat rises naturally due to buoyancy effects. In this case, it may be desirable to apply more heat to the bottom of the door that experiences cooler temperatures from the refrigerated display case 100 and can be more prone to forming condensation.

Figure 4:
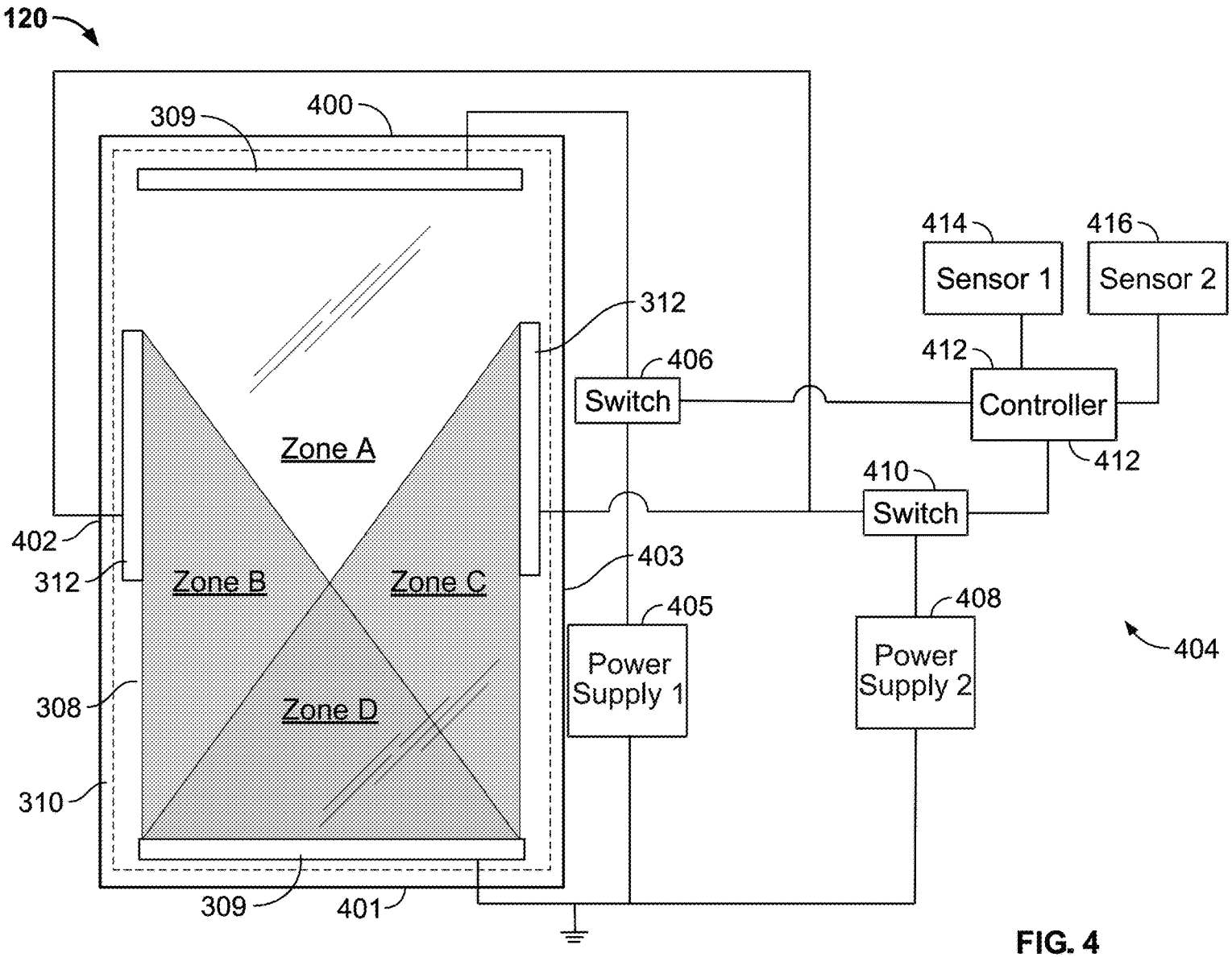
FIG. 4 is a block diagram of an example control system for a panel assembly with heat zone control.

FIG. 4 shows a block diagram of panel assembly 120 with a control system 404 to control heat in various zones of panel assembly 120. The panel assembly 120 includes an electrically conductive coating 308 applied to a surface of one of the panes of glass of panel assembly 120. The panel assembly 120 also includes two pairs of parallel electrical buses or bus bars. The first pair of bus bars 309 are disposed on a first edge 400 and a second edge 401 of panel assembly 120. The first and second edges 400, 401 are on opposite ends of the panel assembly 120. For example, the first edge 400 can be the top edge of the panel assembly 120, and the second edge 401 can be the bottom edge. A second pair of electric bus bars 312 are disposed on a third edge 402 and a fourth edge 403 of the panel assembly 120. The third and fourth edges 402, 403 are opposite each other and adjacent to the first and second edges. For example, the third and fourth edges 402, 403 can be the left and right edges of the panel assembly 120. Each of the bus bars is electrically connected to the electrically conductive coating 308 such that when a voltage difference is applied to the bus bars, an electrical current flows through the electrically conductive coating 308. Each bus bar may include an electrode 340 or solder tab for connecting the electrically conductive coating to lead wires 311 connected to an electrical power source, as depicted in FIG. 3C. In this arrangement, an electric current may pass through one of the lead wires 311, to a first of the bus bars 309 or 312, across the electrically conductive coating 308 to the second bus bar 309 or 312, and through the other lead wire 311.

A control system 404 controls the operation of the bus bars 309, 312 to heat zones of the electrically conductive coating 308 differently. For example, the control system 404 can control the voltage level applied to each bus bar to develop different heating zones (A-D) across the coating 308. In one example, the voltage levels can be controlled such that in zone A, at the top of the panel assembly, there is minimal current flow and consequently little heat being generated by the coating since the top of the panel assembly 120 is generally hotter than the bottom of the panel due to the natural rise of heat. Likewise, more heat can be generated in zone D, toward the bottom of the panel assembly 120, by controlling the voltages applied to the bus bars 309, 312 such that a larger current flows through the electrically conductive coating 308 in zone D than in zone A, and moderate amounts of heat can be generated in the adjacent side zones B and C.

The control system 404 can include a controller 412, one or more power supplies 405/408, one or more switches 406/410, and sensors 414/416. In the example block diagram shown in FIG. 4, the first pair of bus bars 309 can be connected to a first power supply 405 that can apply a voltage between the bus bars 309. A first switch 406 can be electrically connected to the power supply 405 and the first pair of bus bars 309 to control the application of power to the bus bars 309. The second pair of bus bars 312 can be connected to a second power supply 408 that can apply a voltage to the second pair of bus bars 312 such that current flows from the second pair of bus bars to an electrical ground. The electrical ground can be connected to one of the bus bars; for example, the bus bar along the bottom edge 401 of the panel assembly 120 can be connected to the electrical ground. A second switch 410 can be electrically connected to the second power supply 408 and the second pair of bus bars 312 to control the application of power to the second pair of bus bars 312. In some cases, the voltage applied to the second pair of bus bars 312 by the second power supply 408 can be larger than the voltage applied to the first pair of bus bars 309 by the first power supply 405. In some implementations, the voltage applied to the second pair of bus bars 312 can be the same or slightly less than the voltage applied to the first pair of bus bars 309.

A controller 412 can be used to operate the switches 406 and 410 thereby controlling the application of power to the pairs of bus bars 309 and 312. The controller can receive signals from one or more sensors 414 and 416. Examples of sensors that can be used include temperature sensors and humidity sensors. In some implementations, the controller 412 can operate the switches in response to receiving a signal from one or more sensors. For example, a humidity sensor and a temperature sensor can be installed in the refrigerated display case 100. If the measurements of the humidity or temperature by the humidity or temperature sensors are outside of a pre-defined range, the controller 412 can operate one or both switches 406 and 410 to selectively apply power to the pairs of bus bars 309 and 312 to mitigate condensation formation on the panel assembly 120.

The amount of heat generated by the electrically conductive coating 308 can be proportional to the square of the current multiplied by the resistivity of the coating, $P=I^2R$, where P is the power, I is the current, and R is the resistivity. From Ohm's law, the current flowing through the coating is proportional to the voltage, V, across the electrically conductive coating 308 divided by the resistivity of the coating, $I=V/R$. For a fixed resistivity, the current can be controlled by controlling the voltage applied across the coating. Further combining these expressions shows that the heat generated by the current flow can be expressed in terms of the voltage applied across the coating, $P=V^2/R$.

In one example, for a vertically oriented panel assembly 120 with the first pair of bus bars 309 disposed at the top and the bottom edges of panel assembly 120 and the second pair of bus bars 312 disposed at the left and the right edges of panel assembly 120, heating zones can be created by application of voltages to the pairs of bus bars 309 and 312. In this example, the bus bar on the bottom edge 401 of panel assembly 120 can be connected to an electrical ground. Applying a voltage to the bus bar on the top edge 400 of panel assembly 120 can generate a current flow across the electrically conductive coating between the first pair of bus bars 309. At the same time, applying a voltage of the same polarity to the second pair of bus bars 312 can allow the current flowing through the electrically conductive coating 308 to be shaped. For example, applying a similar magnitude voltage to the second pair of bus bars 312 as is applied to the bus bar on the top edge 400 can decrease the current flowing through an upper portion of panel assembly 120 (Zone A) between the second pair of bus bars 402 and the bus bar on the top edge 400 of the panel assembly. The decreased current is a result of a small or zero voltage difference between the 3 bus bars. The low current will result in low heat generation by the electrically conductive coating 308 in Zone A. The current flowing through a lower portion of the electrically conductive coating 308 can be increased at the same time. The current flowing through the lower portion of the coating can be higher for a given voltage difference as a result of a lower resistivity in the coating due to a shorter distance traversed (e.g., the distance from the second pair of bus bars 312 to the bottom edge 401 is shorter than the distance from the top edge 400 to the bottom edge 401). This configuration can apply more heat to the lower portion of panel assembly 120 (Zone D) than to the upper portion (Zone A).

In some implementations, the control system 404 can selectively apply voltages to the bus bars 309, 312 in response to feedback from the sensors 414, 416. For example, if an indicator for condensation is sensed in all zones, the control system can apply a voltage between bus bars 309 and not apply a voltage to bus bars 312 to generate an even heating throughout the electrically conductive coating. In another example, if an indicator of condensation is sensed in Zone D but not in Zone A, voltages can be applied to the bus bars 309, 312 such that current flowing through Zone A is reduced while the current flowing through Zone D is increased thus preferentially heating Zone D.

In some implementations, the control system 404 can apply voltages to the bus bars based on a predefined schedule or in response to an event such as opening the door 112 of the display case 100. In some implementations, the control system 404 can apply voltages to the bus bars 309, 312 continuously.

The shape, size, and number of heat zones designated in the panel assembly can be adjusted based on the desired shape and magnitude of the current flowing through the electrically conductive coating 308. For example, the current in the electrically conductive coating 308 can be shaped by changing the shape, number, or location of the bus bars and the voltages applied to them.

The controller 412 can be, e.g., a processor or microcontroller programed to control the power supplied to conductive coating 308 as described above. In some implementations, the switches can be replaced by voltage regulators. For example, the controller 412 can control the voltage output by the voltage regulators to adjust the voltages applied to each set of buss bars 309, 312. In such implementations, a single power source can be used to supply power to the voltage regulators. Similarly, multiple voltage regulators can be replaced by a single voltage regulator with multiple outputs.

Figure 5B:
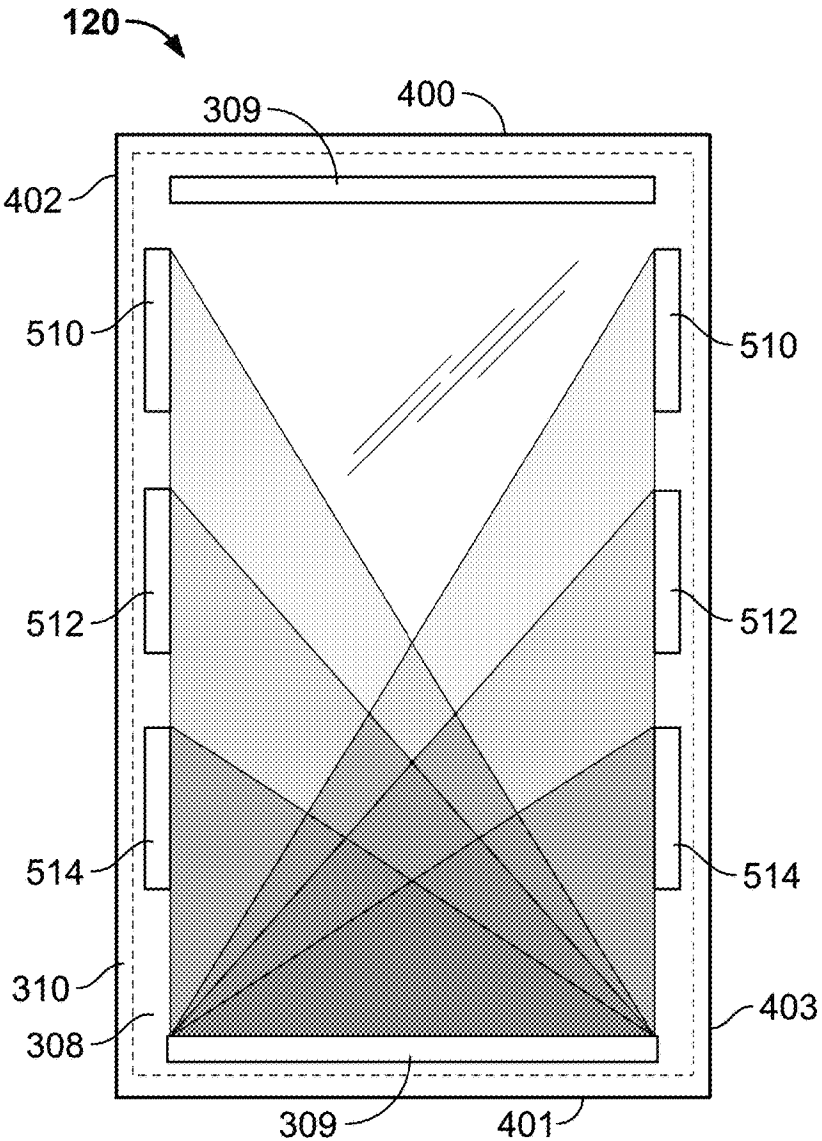
FIGS. 5A-5B are diagrams of example panel assemblies with different electrode configurations.
Figure 5A:
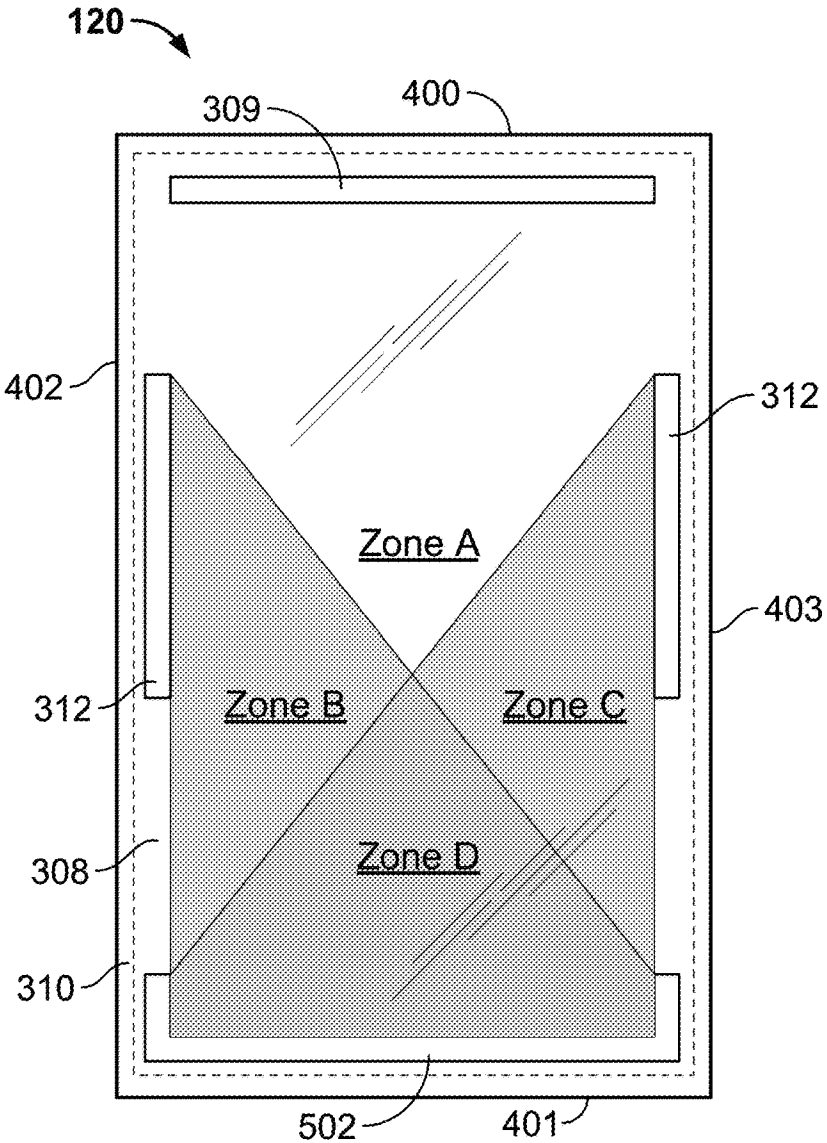

FIG. 5A shows an example diagram of a configuration of bus bars where the shape of Zone D is altered by changing the shape of the bus bar 502 along the bottom edge 401 of panel assembly 120. In this example, bus bar 502 has a U-shape and extends along the bottom edge 401 and partially along each side edge 402, 403 of panel assembly 120.

In this case, the panel assembly can experience a more uniform heating across a larger section near the bottom of the glass pane as compared with the configuration shown in FIG. 4.

FIG. 5B shows an example diagram of a configuration where the number of heating zones is increased by using several pairs of bus bars 510, 512, 514 disposed along the sides 402, 403 of panel assembly 120. The control system connected to the panel assembly 120 can include a power supply and a switch for each pair of bus bars. The control system can be operable to apply a voltage to each set of bus bars independently to generate heat in desired heating zones.

For example, applying a similar magnitude voltage to all pairs of bus bars 510, 512, 514 and the top bus bar of pair 309 with the bottom bus bar connected to electrical ground can result in concentrated heating in the lowest heating zone of panel assembly 120. If voltage is applied to pairs 510 and 512, but not to pair 514, the heat zone can extend further up the panel. If voltage is applied to pair 510 and not to pairs 512 and 514, then the heating zone can extend even further up the panel assembly 120.

Implementations of the subject matter and the operations described in this specification can be realized in analog or digital electronic circuitry, or in computer software, firmware, or hardware, including the structures disclosed in this specification and their structural equivalents, or in combinations of one or more of them. Implementations of the subject matter described in this specification can be realized using one or more computer programs, i.e., one or more modules of computer program instructions for operating a condensation control system, encoded on computer storage medium for execution by, or to control the operation of, data processing apparatus. A computer storage medium can be, or be included in, a computer-readable storage device, a computer-readable storage substrate, a random or serial access memory array or device, or a combination of one or more of them. Moreover, while a computer storage medium is not a propagated signal; a computer storage medium can be a source or destination of computer program instructions encoded in an artificially generated propagated signal. The computer storage medium can also be, or be included in, one or more separate physical components or media (e.g., internal memory on a microcontroller).

The operations described in this specification can be implemented as operations performed by a data processing apparatus on data stored on one or more computer-readable storage devices or received from other sources.

The term "controller" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, or a combination of one or more of them.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Devices suitable for storing computer program instructions and data include all forms of non-volatile memory, media and memory devices, including by way of example semiconductor memory devices, e.g., EPROM, EEPROM, and flash memory devices. The processor and the memory can be supplemented by, or incorporated in, special purpose logic circuitry.

A number of embodiments of the invention have been described. Nevertheless, it will be understood that various modifications may be made without departing from the spirit and scope of the invention. For example, the configurations of the bus bars are not limited to the example embodiments shown herein. Accordingly, other embodiments are within the scope of the following claims.

What is claimed is:

1. A refrigerated display case door glass panel assembly, comprising:

a first pane of glass and a second pane of glass bounding a sealed space between the first pane and the second pane; and an electrically conductive coating applied to a surface of the first pane, the electrically conductive coating extending across at least a majority of a viewing area of the first pane;

a first pair of electrical buses spaced apart from one another and electrically connected to the electrically conductive coating at respective first and second ends of the first pane, the first and second ends being opposite one another;

a second pair of electrical buses spaced apart from one another and electrically connected to the electrically conductive coating at respective third and fourth ends of the first pane, the third and fourth ends being opposite one another and adjacent to the first and second ends;

a first power supply configured to supply power to the first pair of electrical buses; and a second power supply configured to supply power to the second pair of electrical buses.

2. The refrigerated display case door glass panel assembly of claim 1, further comprising a third pair of electrical buses spaced apart from one another and spaced apart from the second pair of electrical buses, the third pair of electrical buses electrically connected to the electrically conductive coating at the respective third and fourth ends of the first pane.

3. The refrigerated display case door glass panel assembly of claim 1, wherein one of the electrical buses in the first pair comprises a U-shape that extends completely across the second end of the first pane and partially extends along the third and fourth ends.

4. The refrigerated display case door glass panel assembly of claim 1, wherein the second power supply is configured to supply more power than the first power supply.

5. The refrigerated display case door glass panel assembly of claim 1, wherein the second power supply is configured to supply a higher output voltage than the first power supply.

6. The refrigerated display case door glass panel assembly of claim 1, wherein the second end of the first pane forms a bottom end of the refrigerated display case door glass panel assembly when mounted in a door, wherein an electrical bus of the first pair of electrical buses positioned at the second end of the first pane is connected to an electrical ground, wherein an electrical bus of the first pair of electrical buses positioned at the second end of the first pane is electrically connected to an output of the first power supply, and wherein each of the second pair of electrical buses are electrically connected to an output of the second power supply.

7. The refrigerated display case door glass panel assembly of claim 1, wherein each bus of the first pair of electrical buses extends entirely across the respective first or second end of the first pane, and wherein each bus of the second pair of electrical buses extends along only a portion of the respective third or fourth end of the second pane.

8. The refrigerated display case door glass panel assembly of claim 1, further comprising:

a first switch electrically connected between the first power supply and the first pair of electrical buses; and a second switch electrically connected between the second power supply and the second pair of electrical buses, wherein the first switch and the second switch are operable to control the power suppled from the first power supply to the first pair of electrical buses and from the second power supply to the second pair of electrical buses, respectively.

9. A refrigerated display case door, comprising:

a glass panel assembly comprising:

a first pane of glass and a second pane of glass bounding a sealed space between the first pane and the second pane; and an electrically conductive coating applied to a surface of the first pane, the electrically conductive coating extending across at least a majority of a viewing area of the first pane;

a first pair of electrical buses spaced apart from one another and electrically connected to the electrically conductive coating at respective first and second ends of the first pane, the first end positioned at a top of the refrigerated display case door and the second end positioned at a bottom of the refrigerated display case door; and a second pair of electrical buses spaced apart from one another and electrically connected to the electrically conductive coating at respective third and fourth ends of the first pane, the third and fourth ends being opposite one another and adjacent to the first and second ends; and a controller configured to supply power independently to the first pair of electrical buses and the second pair of electrical buses, the controller operable to perform operations comprising controlling a voltage level applied to each bus bar to develop different heating zones across the electrically conductive coating.

10. The refrigerated display case door of claim 9, further comprising a third pair of electrical buses spaced apart from one another and spaced apart from the second pair of electrical buses, the third pair of electrical buses electrically connected to the electrically conductive coating at the respective third and fourth ends of the first pane.

11. The refrigerated display case door of claim 9, wherein one of the electrical buses in the first pair comprises a U-shape that extends completely across the second end of the first pane and partially extends along the third and fourth ends.

12. The refrigerated display case door of claim 9, further comprising a first power supply and a second power supply, wherein the first pair of electrical buses receive power from the first power supply, and the second pair of electrical buses receive power from the second power supply, the second power supply configured to supply more power than the first power supply.

13. The refrigerated display case door of claim 12, wherein the second power supply is configured to supply a higher output voltage than the first power supply.

14. The refrigerated display case door of claim 12, wherein an electrical bus of the first pair of electrical buses positioned at the second end of the first pane is connected to an electrical ground, wherein an electrical bus of the first pair of electrical buses positioned at the second end of the first pane is electrically connected to an output of the first power supply, and wherein each of the second pair of electrical buses are electrically connected to an output of the second power supply.

15. The refrigerated display case door of claim 9, wherein each bus of the first pair of electrical buses extends entirely across the respective first or second end of the first pane, and wherein each bus of the second pair of electrical buses extends along only a portion of the respective third or fourth end of the second pane.

16. The refrigerated display case door of claim 9, wherein controlling the voltage level applied to each bus bar to develop different heating zones across the electrically conductive coating comprises controlling the voltage level such that a first current flows in a first zone, a second current flows in a second zone, and a third current flows in a third zone, wherein the third current is greater than the first current and the second current, and the second current is greater than the first current, wherein the second zone is bordered by the first zone and the third zone, the first zone extends downward from the top of the glass panel assembly to the second zone, the third zone extends upward from the bottom of the glass panel assembly to the second zone.

17. The refrigerated display case door of claim 9, wherein the controller is further configured to control power flow to the first pair of buses and the second pair of buses to provide more heating current to a heating zone proximate to the bottom of the refrigerated display case door than to a heating zone proximate the top of the refrigerated display case door.

18. A condensation control system configured to control power flow to a first pair of electrical buses and a second pair of electrical buses, each pair of electrical buses connected, at different locations, to an electrically conductive coating on a glass surface of a refrigerated display case door, the condensation control system configured to control the power flow to the first pair of electrical buses and the second pair of electrical buses such that more heating current flows to a heating zone proximate to a bottom of the refrigerated display case door than to a heating zone proximate a top of the refrigerated display case door.

19. The condensation control system of claim 18, further comprising at least one condensation sensor, and wherein the condensation control system is configured to control a voltage applied to the first pair of electrical buses and the second pair of electrical buses responsive to input received from the at least one condensation sensor.

20. The condensation control system of claim 18, wherein the first pair of electrical buses are spaced apart from one another and electrically connected to the electrically conductive coating at respective first and second ends of the glass surface, the first end positioned at a top of the refrigerated display case door and the second end positioned at a bottom of the refrigerated display case door, and wherein the second pair of electrical buses are spaced apart from one another and electrically connected to the electrically conductive coating at respective third and fourth ends of the glass surface, the third and fourth ends being opposite one another and adjacent to the first and second ends.

* * * * *